US012612202B2

(12) United States Patent
Ostryzniuk et al.

(10) Patent No.: US 12,612,202 B2
(45) Date of Patent: Apr. 28, 2026

(54) SYSTEM FOR COMPRESSING AND STRAPPING LOADS WITH PRESS-TYPE STRAPPING MACHINES HAVING IMPROVED PLATEN CONTROL

(71) Applicant: Signode Industrial Group LLC, Tampa, FL (US)

(72) Inventors: Nicole Ostryzniuk, St. John, IN (US); Joel Patel, Hawthorn Woods, IL (US); Douglas Felsecker, Saint Charles, IL (US); Joseph Edward Lininger, Union Grove, WI (US)

(73) Assignee: Signode Industrial Group LLC, Tampa, FL (US)

( * ) Notice: Subject to any disclaimer, the term of this patent is extended or adjusted under 35 U.S.C. 154(b) by 262 days.

(21) Appl. No.: 18/291,723

(22) PCT Filed: Jul. 29, 2021

(86) PCT No.: PCT/US2021/043604
§ 371 (c)(1),
(2) Date: Jan. 24, 2024

(87) PCT Pub. No.: WO2023/009119
PCT Pub. Date: Feb. 2, 2023

(65) Prior Publication Data

US 2025/0091744 A1 Mar. 20, 2025

(51) Int. Cl.
*B65B 13/04* (2006.01)
*B65B 13/18* (2006.01)
*B65B 13/20* (2006.01)

(52) U.S. Cl.
CPC ..... *B65B 13/04* (2013.01); *B65B 13/18* (2013.01); *B65B 13/20* (2013.01)

(58) Field of Classification Search
CPC ..... B65B 13/04; B65B 13/18; B65B 13/20
See application file for complete search history.

(56) References Cited

U.S. PATENT DOCUMENTS 2,933,207 A * 4/1960 Edmonds ..... B65B 35/50 414/931
4,018,146 A 4/1977 Evans
(Continued)

FOREIGN PATENT DOCUMENTS

CA 3058609 A1 5/2020
DE 102014103331 A1 9/2015
(Continued)

OTHER PUBLICATIONS

"International Search Report and Written Opinion", from corresponding PCT/US2021/043604, May 13, 2022.

*Primary Examiner* — Jimmy T Nguyen
(74) *Attorney, Agent, or Firm* — Neal, Gerber & Eisenberg LLP

(57) ABSTRACT

A system for compressing and strapping loads with press-type strapping machines having improved platen control is provided. The system includes first and second strapping machines each configured to compress and strap a load. The first strapping machine applies a compressive force to the load until a target compressive force is reached and then straps the load. The second strapping machine compresses the load until the height of the load is substantially the same as the height of the load when the first strapping machine strapped the load. The second strapping machine then straps the load. The system ensures the height of the load is substantially the same during each strapping operation.

20 Claims, 10 Drawing Sheets

(56) References Cited

U.S. PATENT DOCUMENTS

| | | | |
|---|---|---|---|
| 4,635,542 | A | 1/1987 | Sebelist et al. |
| 4,938,009 | A | 7/1990 | Takami |
| 5,353,315 | A | 10/1994 | Scarola et al. |
| 6,546,696 | B2 | 4/2003 | Cranston et al. |
| 7,240,612 | B1 | 7/2007 | Kirar et al. |
| 7,281,403 | B2 | 10/2007 | Sperrer |
| 7,428,865 | B1 | 9/2008 | Kasel et al. |
| 7,765,778 | B2 | 8/2010 | Schuttler et al. |
| 7,798,060 | B2 | 9/2010 | Pearson et al. |
| 8,413,574 | B2 | 4/2013 | Oehm et al. |
| 8,689,684 | B2 | 4/2014 | Haberstroh et al. |
| 8,707,863 | B2 | 4/2014 | Zitzmann |
| 9,032,869 | B2 | 5/2015 | Harris et al. |
| 9,145,283 | B2 | 9/2015 | Oehm et al. |
| 9,238,516 | B2 | 1/2016 | Termanas |
| 10,017,283 | B2 | 7/2018 | Kastner |
| 2006/0168917 | A1 | 8/2006 | Ashkenazi |
| 2012/0299727 | A1 | 11/2012 | Newman et al. |
| 2018/0229869 | A1 | 8/2018 | Schultz |
| 2018/0237177 | A1 | 8/2018 | Schultz et al. |
| 2018/0244413 | A1 | 8/2018 | Oehm et al. |
| 2020/0139657 | A1 | 5/2020 | Termanas et al. |

FOREIGN PATENT DOCUMENTS

| | | | |
|---|---|---|---|
| DE | 102014103332 | B4 | 4/2025 |
| DE | 102014103331 | B4 | 6/2025 |
| EP | 0681958 | A1 | 11/1995 |
| EP | 0931449 | A1 | 7/1999 |
| EP | 2660158 | A1 | 11/2013 |
| EP | 2700577 | A1 | 2/2014 |
| EP | 2700578 | A1 | 2/2014 |
| EP | 2700579 | A1 | 2/2014 |
| EP | 2733077 | A1 | 5/2014 |
| EP | 2778075 | A1 | 9/2014 |
| EP | 2778076 | A1 | 9/2014 |

* cited by examiner

SYSTEM FOR COMPRESSING AND STRAPPING LOADS WITH PRESS-TYPE STRAPPING MACHINES HAVING IMPROVED PLATEN CONTROL

PRIORITY

This application is a national phase application of and claims priority to and the benefit of PCT/US2021/043604, filed on Jul. 29, 2021, the entire contents of which is incorporated herein by reference.

FIELD

The present disclosure relates to systems for compressing and strapping loads with press-type strapping machines, and more particularly to systems for compressing and strapping loads with press-type strapping machines having improved platen control.

BACKGROUND

A strapping machine forms a tensioned loop of plastic strap (such as polyester or polypropylene strap) or metal strap (such as steel strap) around a load. A typical strapping machine includes a support surface that supports the load, a strap chute that defines a strap path and circumscribes the support surface, a strapping head that forms the strap loop and is positioned in the strap path, a controller that controls the strapping head to strap the load, and a frame that supports these components. To strap the load, the strapping head first feeds strap (leading strap end first) from a strap supply into and through the strap chute (along the strap path) until the leading strap end returns to the strapping head. While holding the leading strap end, the strapping head retracts the strap to pull the strap out of the strap chute and onto the load and tensions the strap to a designated strap tension. The strapping head then cuts the strap from the strap supply to form a trailing strap end and attaches the leading and trailing strap ends to one another, thereby forming a tensioned strap loop around the load. Certain strapping machines have multiple strapping heads and respective strap chutes that define respective strap paths. These strapping machines are configured to simultaneously form multiple tensioned strap loops (using strap from separate respective strap supplies) around a load.

Press-type strapping machines are configured to apply a compressive force to the load to partially compress the load, such as to partially compress a stack of flattened corrugated sheets, before strapping the load using multiple strapping heads. A typical press-type strapping machine includes a platen supported by the frame and vertically movable relative to the support surface and the load. Before strapping the load, the platen moves downward toward the support surface and into contact with the load. As the platen continues moving downward, it and applies a compressive force to the load and starts compressing the load. As this occurs, the controller monitors the applied compressive force the platen applies to the load, and stops the platen once the applied compressive force reaches a target compressive force. At this point, the load is partially compressed, and the controller controls the strapping heads to strap the load. The platen then moves upward (away from the support surface and the load) to disengage the load and enable the load to be moved out of the strapping machine. As the platen moves upward and disengages the load, the load attempts to return to its original height by expanding upward. As this occurs, the strap loop(s) stretch slightly ender this expansion force but prevent full expansion such that the strapped load is shorter than it was before compression and strapping but taller than it was when compressed. Compressing the loads before strapping not only makes the loads more compact and easier to store and handle, but also ensures the straps tightly bind the load together.

Certain systems include multiple press-type strapping machines positioned in-line with one another that are each configured to separately strap the load as the load is conveyed from one strapping machine to the other. For instance, in one such system, a load is conveyed to a first press-type strapping machine that applies four straps to the load. The load is then conveyed to a second press-type strapping machine that applies four more straps to the load at different locations than the four straps applied by the first strapping machine. The result is a load strapped eight times.

Loose straps are a common issue plaguing these types of systems. As explained above, these press-type strapping machines monitor the compressive force applied to a load and stop moving the platen and strap the load when the applied compressive force reaches a target compressive force. When the first press-type strapping machine compresses the load, it slightly weakens the load (such as by slightly deforming the flutes of corrugated sheets) and reduces its ability to resist the compressive force applied by the second press-type strapping machine. In other words, it makes the load easier for the next strapping machine to compress. This means that, as compared to the first press-type strapping machine, the platen of the second press-type strapping machine has to move further toward the support surface to reach the target compressive force before strapping the load. This results in the load being shorter when strapped by the second strapping machine than it is when strapped by the first strapping machine, which in turn results in the straps applied by the first strapping machine being looser than those applied by the second strapping machine. This means that the expansion force of the load is exerted on only the later-applied straps, which increases the likelihood of breakage.

SUMMARY

Various embodiments of the present disclosure provide systems for compressing and strapping loads with press-type strapping machines having improved platen control. The system includes first and second strapping machines each configured to compress and strap a load. The first strapping machine applies a compressive force to the load until a target compressive force is reached and then straps the load. The second strapping machine compresses the load until the height of the load is substantially the same as the height of the load when the first strapping machine strapped the load. The second strapping machine then straps the load. The system solves the above problems by ensuring the height of the load is substantially the same during each strapping operation.

DETAILED DESCRIPTION

Figure 1:
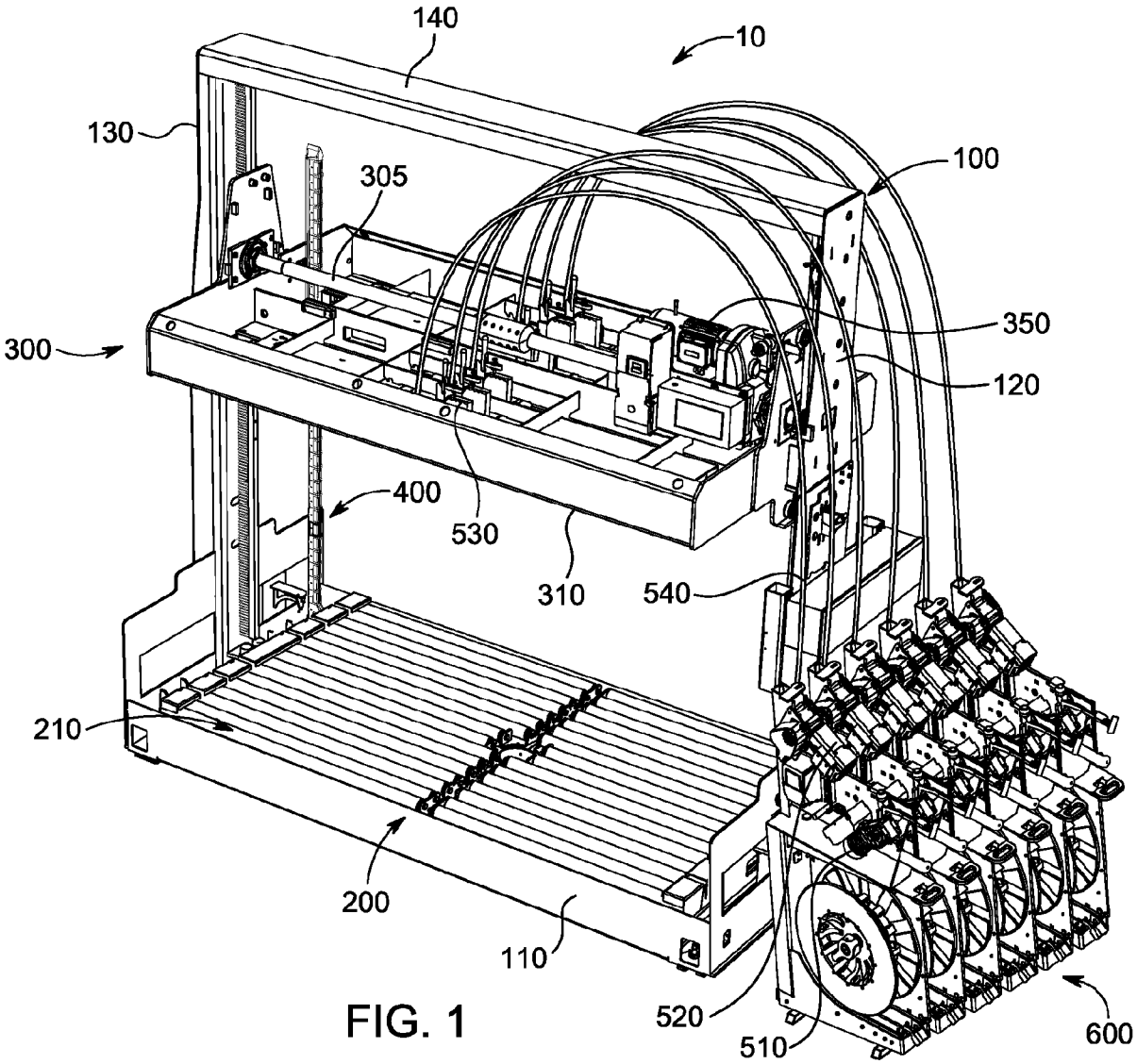
FIG. 1 is a perspective view of one example embodiment of a strapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Various embodiments of the present disclosure provide systems for compressing and strapping loads with press-type strapping machines having improved platen control. The system includes first and second strapping machines each configured to compress and strap a load. The first strapping machine applies a compressive force to the load until a target compressive force is reached and then straps the load. The second strapping machine compresses the load until the height of the load is substantially the same as the height of the load when the first strapping machine strapped the load. The second strapping machine then straps the load. The system solves the above problems by ensuring the height of the load is substantially the same during each strapping operation.

Figure 2:
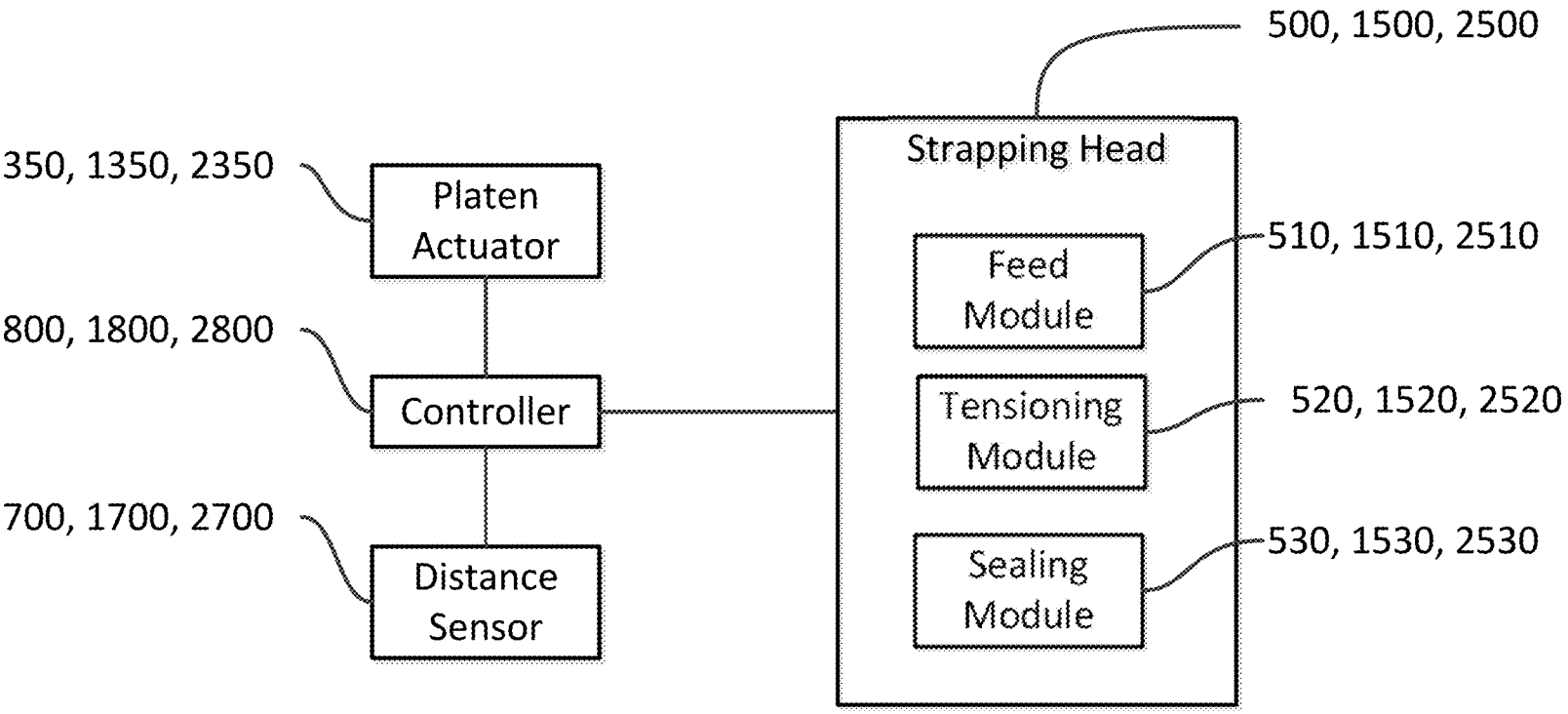
FIG. 2 is a block diagram showing certain components of the strapping machine of FIG. 1.

FIGS. 1 and 2 show one embodiment of the press-type strapping machine 10 of the present disclosure (referred to as the "strapping machine" below for brevity) and components thereof. The strapping machine 10 includes a frame 100, a load supporter 200, a platen 300, a platen actuator 350, multiple strap chutes 400 (only one of which is labeled for clarity), multiple strapping heads 500 (only one of which is labeled for clarity) each configured to draw strap from a respective strap supply 600 (only one of which is labeled for clarity), a distance sensor 700, a compression sensor (not shown), and a controller 800.

The frame 100 is configured to support some (or all) of the other components of the strapping machine 10. In this example embodiment, the frame 100 includes a base 110, first and second spaced-apart upstanding legs 120 and 130, and connector 140 that spans and connects the upper ends of the first and second legs 120 and 130. Although not labeled, the first and second legs 120 and 130 each include a vertically extending toothed rack to enable the platen 300 to move relative to the first and second legs 120 and 320 in a rack-and-pinion fashion, as described below. This is merely one example of a configuration of components that form the frame 100, and any other suitable configuration of any other suitable components may form the frame 100 in other embodiments.

The load supporter 200 is positioned atop the base 110, between the first and second legs 120 and 130, and below the connector 140 of the frame 100. The load supporter 200 is configured to support loads as they are compressed and strapped by and as they move through the strapping machine 10. The load supporter 200 includes a support surface 210 on which the loads are positioned during compression and strapping and over which loads move as they move through the strapping machine 10. In this example embodiment, the support surface 210 includes multiple rollers that facilitate movement of the load through the strapping machine 10. The rollers may be driven or undriven. In other embodiments, the support surface includes a driven conveyor instead of rollers.

The platen 300 is supported by the first and second legs 120 and 130 above the load supporter 200 and is vertically movable relative to the load supporter 200 so the platen 300 can adjust to loads of different heights and apply a compressive force to the loads. In this example embodiment, the platen 300 includes two rotatable pinions (not shown) fixed to a pinion shaft 305 such that the pinions and the pinion shaft 305 rotate together. The pinion shaft 305 extends between the first and second legs 120 and 130 such that one pinion meshes with the toothed rack in the first leg 120 and the other pinion meshes with the toothed rack in the second leg 130. In this configuration, rotation of the pinions (which rotate together via their fixed connection to the pinion shaft 305) under control of the platen actuator 350 (described below) causes the pinions to climb or descend their respective toothed racks such that the platen 300 moves away from or toward the support surface 210 of the load supporter 200 (i.e., upward or downward, as described in more detail below). The platen 300 also includes one or more compression surfaces 310 on its underside for contacting and applying the compressive force to the load.

The platen actuator 350 is any suitable actuator, such as an electric, pneumatic, or hydraulic motor, operably connected to the platen 300 to move the platen 300 relative to the first and second legs 120 and 130 toward and away from the support surface 210 of the load supporter 200 (i.e., downward and upward). In this example embodiment, the platen actuator 350 is operably connected to the pinions and the pinion shaft 305 of the platen 300 via gearing (not shown) such that rotation of an output shaft (not shown) of the platen actuator 350 results in rotation of the pinions (and the pinion shaft 305) and vertical movement of the platen 300. In one example embodiment, an output gear (not shown) of the gearing is meshed with one of the pinions such that rotation of the output gear (caused by rotation of the output shaft of the platen actuator 350) directly causes that pinon to rotate, which in turn causes the pinion shaft 305 and the other pinion to rotate. Rotating the output shaft of the platen actuator 350 in one direction results in movement of the platen 300 away from the support surface 210, and rotation of the output shaft in the opposite direction results in movement of the platen 300 toward the support surface 210. This is merely one example embodiment of the platen actuator, and any suitable actuator may be employed. Additionally, any other suitable manner of controlling vertical movement of the platen 300 may be employed (e.g., hydraulic or pneumatic cylinders, belt-and-pulley assemblies, and the like), as the rack-and-pinion configuration is merely one example embodiment.

The strap chute 400 circumscribes the support surface 210 and defines a strap path that the strap follows when fed through the strap chute 400 and from which the strap is removed when retracted. The strap chute 400 includes two spaced-apart first and second upstanding legs (not labeled), an upper connecting portion (not shown) that spans the first and second legs and is positioned in the platen 300, a lower connecting portion (not shown) that spans the first and second legs and is positioned in the load supporter 200, and elbows that connect these portions. As is known in the art, the radially inward wall of the strap chute 400 is formed from multiple overlapping gates that are spring biased to a closed position that enables the strap to traverse the strap path when fed through the strap chute 400. When the strapping head 500 later exerts a pulling force on the strap to retract the strap, the pulling force overcomes the biasing force of the springs and causes the gates to pivot to an open position, thereby releasing the strap from the strap chute so the strap contacts the load as the strapping head 500 continues to retract the strap.

The strapping head 500 is configured to form a tensioned strap loop around the load by feeding the strap through the strap chute 400 along the strap path, holding the leading strap end while retracting the strap to remove it from the strap chute 400 so it contacts the load, tensioning the strap around the load to a designated tension, cutting the strap from the strap supply to form a trailing strap end, and connecting the leading strap end and trailing strap end to one another. In this example embodiment, the strapping head 500 is a modular strapping head including independently removable and replaceable feed, tensioning, and sealing modules 510, 520, and 530. The feed module 510, which is configured to feed and retract the strap, and the tensioning module 520, which is configured to tension the strap, are mounted to a frame (not labeled) of the strap supply 600. That is, in this example embodiment, the feed and tensioning modules 510 and 520 are located remote from the strapping machine 10 (though in other embodiments the feed and/or tensioning modules 510 and 520 may be supported by the frame 100, the platen 300, or any other suitable component of the strapping machine 10). The platen 300 supports the sealing module 530, which is configured to hold the leading strap end, cut the strap from the strap supply, and connect the leading strap end and trailing strap end to one another. A strap guide 540 extends between the feed and tensioning modules 510 and 520 and the sealing module 530 and is configured to guide the strap as it moves between the modules.

This is merely one example strapping head, and the strapping machine 10 may include any suitable modular strapping head or non-modular strapping head (i.e., a strapping head that is not comprised of independently removable and replaceable feed and sealing modules). The manner of attaching the leading and trailing strap ends to one another depends on the type of strapping machine and the type of strap. Certain strapping machines configured for plastic strap include strapping heads with friction welders, heated blades, or ultrasonic welders configured to attach the leading and trailing strap ends to one another. Some strapping machines configured for plastic strap or metal strap include strapping heads with jaws that mechanically deform (referred to as "crimping" in the industry) or cut notches into (referred to as "notching" in the industry) a seal element positioned around the leading and trailing strap ends to attach them to one another. Other strapping machines configured for metal strap include strapping heads with punches and dies configured to form a set of mechanically interlocking cuts in the leading and trailing strap ends to attach them to one another (referred to in the strapping industry as a "sealless" attachment). Still other strapping machines configured for metal strap include strapping heads with spot, inert-gas, or other welders configured to weld the leading and trailing strap ends to one another.

The distance sensor 700 is mounted to the underside of the connector 140 of the frame 100 and is configured to detect the vertical distance D (labeled in FIGS. 4A-4F) between the distance sensor 700 and the platen 300. The system of the present disclosure uses feedback from the distance sensor 700—and particularly the measured distance when the platen 300 has stopped after compressing the load—to ensure that the platens of each strapping machine of the system (explained below) are substantially the same strapping distance from their respective support surfaces when strapping the load (meaning that the load is substantially the same height when strapped by each strapping machine). As used herein, "substantially the same" means within at least 5% of and preferably within 1% of one another. In this example embodiment, the distance sensor 700 is a laser sensor, and a target is mounted to the platen 300 such that the distance sensor 700 is configured to measure the distance D between the distance sensor 700 and the target on the platen 300. The distance sensor may be any other suitable sensor, such as an ultrasonic sensor, an infrared sensor, a time-of-flight sensor, or an encoder. Additionally, while in this example embodiment the distance sensor is configured to measure the distance between itself and the platen (and more specifically, the target on the platen), the distance sensor may be configured to measure any suitable distance that can be used to directly or indirectly determine the distance between the platen and the support surface (such as the distance between a component on the platen and any other stationary component of the strapping machine, including the support surface itself).

The compression sensor is mounted to the underside of (or otherwise integrated into) the load supporter 200 and configured to detect a force applied to the load supporter 200 (such as by the load and the platen applying a compressive force to the load). In this example embodiment, the compression sensor is a load cell, though any other suitable sensor may be employed. The strapping machine may include any suitable quantity of compression sensors.

The controller 800 includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 10.

The controller 800 is communicatively and operably connected to the platen actuator 350 and the strapping head 500 to receive signals from and to control those components.

The controller 800 is communicatively connected to the distance sensor 700 and the compression sensor to receive signals from these sensors. As described below, the controller 800 is configured to control the platen actuator 350 and the strapping head 500 responsive to signals received from the platen actuator 350 and the compression sensor and/or the distance sensor 700, depending on the implementation.

The controller 800 is configured to determine the compressive force Fc the platen 300 applies to the load based on feedback received from the compression sensor. Specifically, after a load is introduced atop the support surface 210 and below the platen 300 into a strapping area of the strapping machine 10, the controller 800 determines the weight of the load based on a force reading received from the compression sensor. After the platen 300 contacts the load, the controller 800 determines the applied compressive force Fc by determining the difference between the force reading received from the compression sensor (which would equal the weight of the load plus the applied compressive force Fc) and the weight of the load. Alternatively, the controller 800 zeroes (or tares) the compression sensor after the load is positioned in the strapping area. In this embodiment, the applied compressive force $F_C$ is equal to the force reading received from the compression sensor. In other embodiments in which the strapping machine does not include a compression sensor, the controller determines the applied compressive force based on the current drawn by the platen actuator. In other words, in these embodiments, the controller is configured to measure the current drawn by the platen actuator and convert that measurement into the compressive force the platen applies to the load.

The controller 800 is configured to determine the distance D based on a distance reading received from the distance sensor 700. In this example embodiment, the controller 800 is configured to determine the distance (not labeled) between the support surface 210 and the compression surfaces 310 based on this distance D, such as via a lookup table correlating the two distances or by subtracting the distance D and the known distance between the designated component (here, the target) and the compression surfaces 310 from the known distance between the distance sensor 700 and the support surface 210.

As shown in FIGS. 4A-4F, the present disclosure provides a system for strapping a load L. The system comprises in-line first and second press-type strapping machines 1000 and 2000 separated by a driven conveyor (not labeled). The first and second strapping machines 1000 and 2000 are identical to the strapping machine 10 described above and therefore not separately described. Components of the first and second strapping machines 1000 and 2000 are identified using the same element numbering as for those of the strapping machine 10, but with a leading "1" and "2," respectively.

Figure 3A:
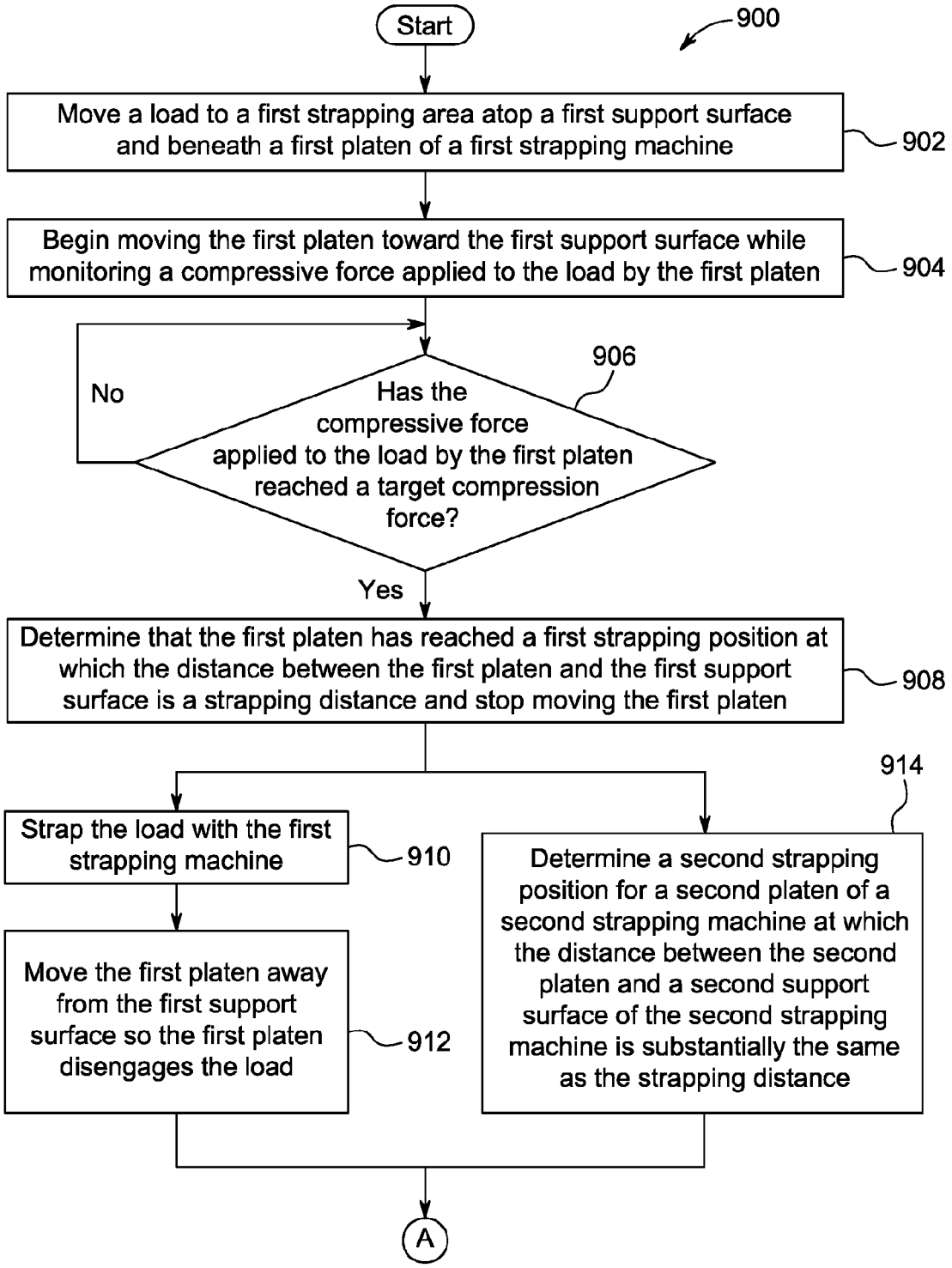
FIGS. 3A and 3B are a flowchart showing a method of operating a system of the present disclosure to carry out a strapping process.
Figure 3B:
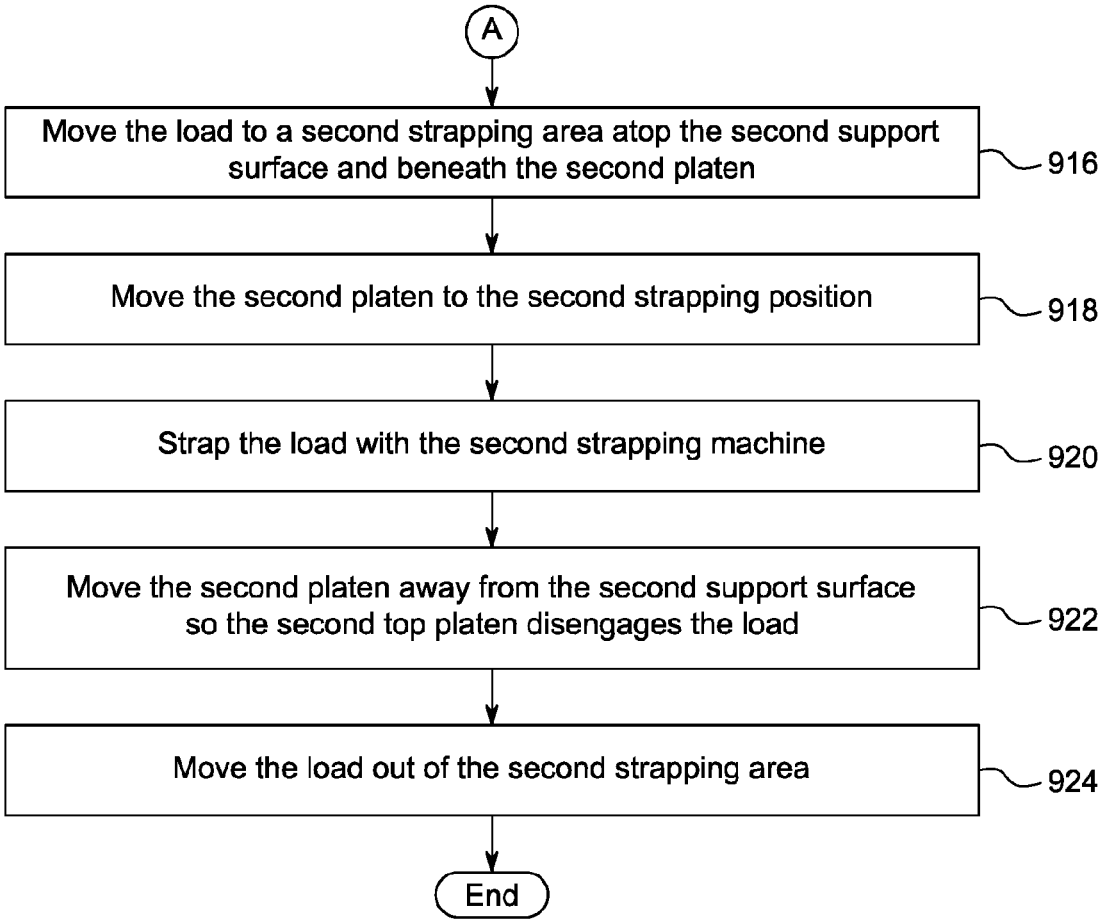

Operation of the system to conduct a strapping process 900 (sometimes referred to below as the "process 900" for brevity) to strap the load L is now described in conjunction with the flowchart shown in FIGS. 3A and 3B and the example embodiment of the system shown in FIGS. 4A-4F. In this example embodiment, the system uses feedback from the distance and compression sensors to ensure the load is adequately compressed and that the platens of the strapping machines of the system are the same or substantially the same strapping distance from their respective support surfaces when strapping the load to prevent loose straps.

Figure 4A:
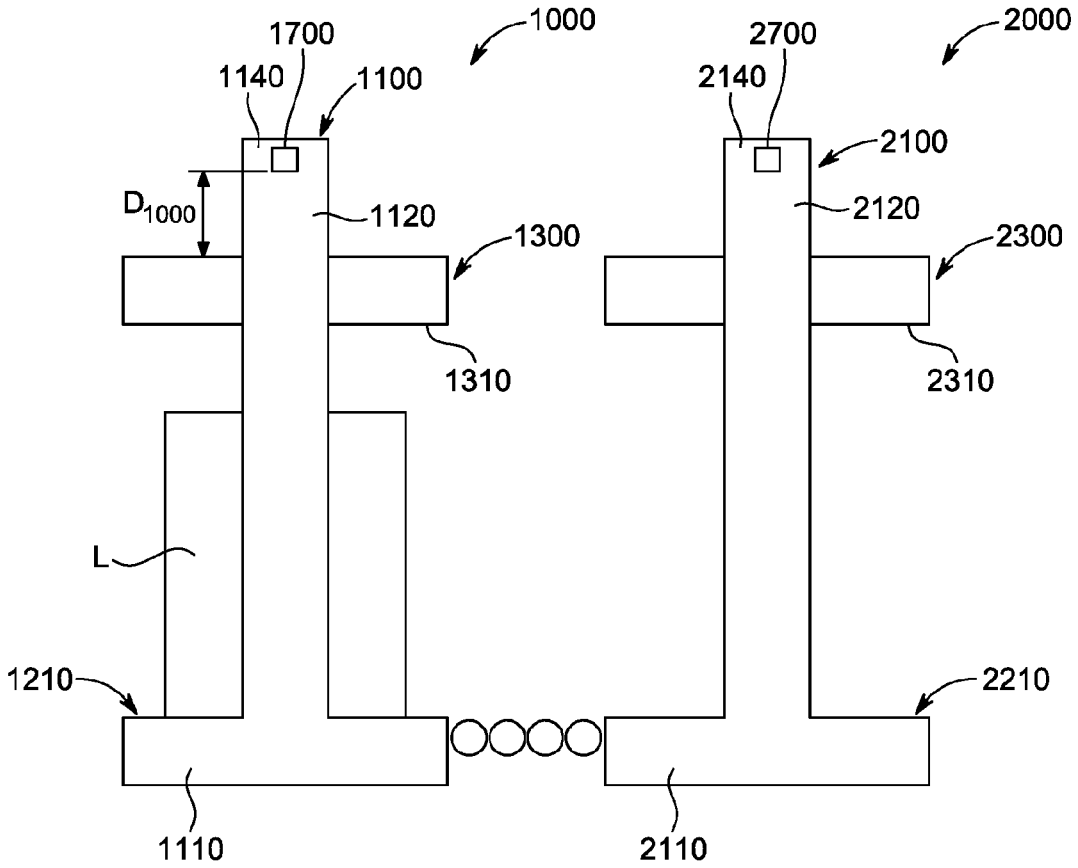
FIGS. 4A-4F are simplified elevational views of one example embodiment of the system of FIGS. 3A and 3B during one example embodiment of the strapping process of FIGS. 3A and 3B.
Figure 4B:
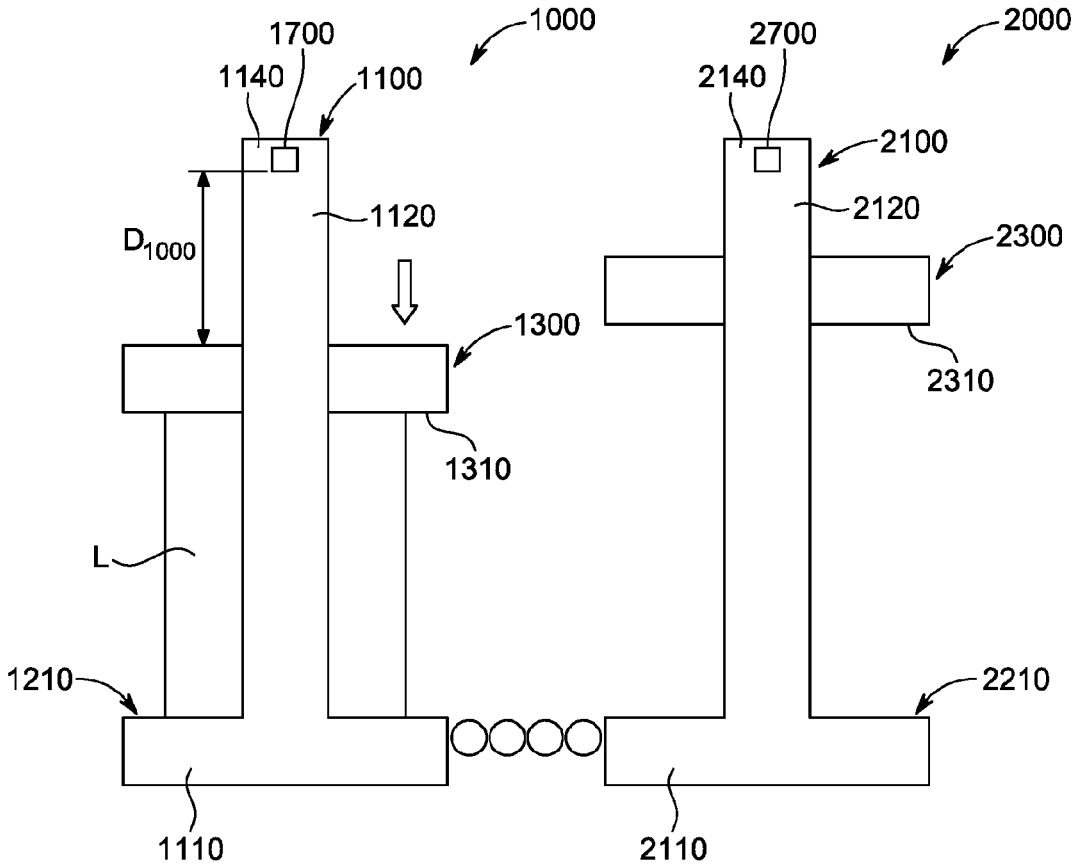

To start the process 900, the load L is moved to a first strapping area atop the support surface 1210 and beneath the platen 1300 of the first strapping machine 1000, as block 902 indicates and as shown in FIG. 4A. The controller 1800 controls the platen actuator 1350 to begin moving the platen 1300 toward the support surface 1210 and into contact with the load L, as block 904 indicates and as shown in FIG. 4B. As this occurs, the compression sensor (not shown) periodically sends force readings to the controller 1800, which determines and monitors the applied compressive force Fc, as block 904 also indicates and as described above.

Figure 4C:
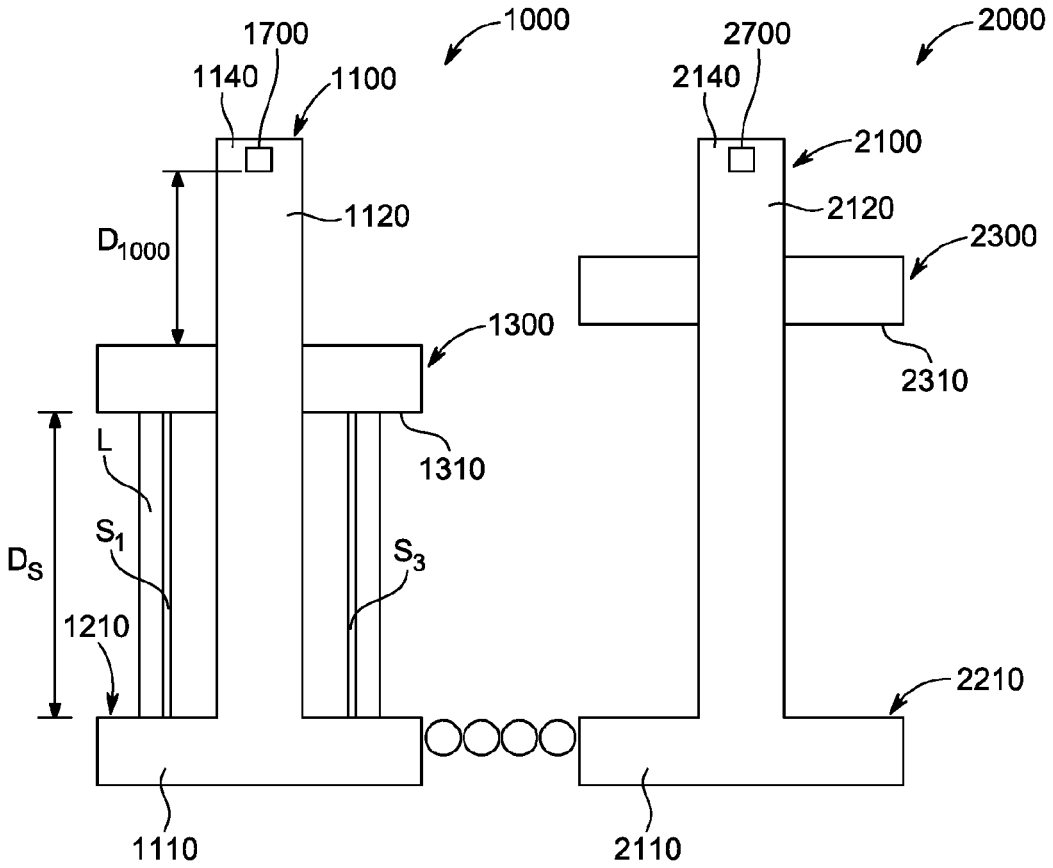

The controller 1800 monitors the applied compressive force $F_C$ to determine whether the applied compressive force $F_C$ has reached a target compression force, as diamond 906 indicates. The target compression force may be any suitable force set by the operator or otherwise. Once the controller 1800 determines that the applied compressive force $F_C$ has reached the target compression force, the controller 1800 determines that the platen 1300 has reached a first strapping position and controls the platen actuator 1350 to stop moving the platen 1300, as block 908 indicates and as shown in FIG. 4C. When the platen 1300 is in the first strapping position, the distance between the platen 1300 (and specifically the compression surfaces 1310) and the support surface 1210 is a strapping distance $D_S$, as block 908 also indicates. In this example embodiment, the controller 1800 determines the strapping distance $D_S$ using a distance reading from the distance sensor 1700. Specifically, in this example embodiment, the distance reading received from the distance sensor 1700 enables the controller 1800 to determine a distance $D_{1000}$ between the distance sensor 1700 and the platen 1300 (and more specifically, the target), which (as described above) the controller 1800 uses to determine $D_S$.

Figure 4D:
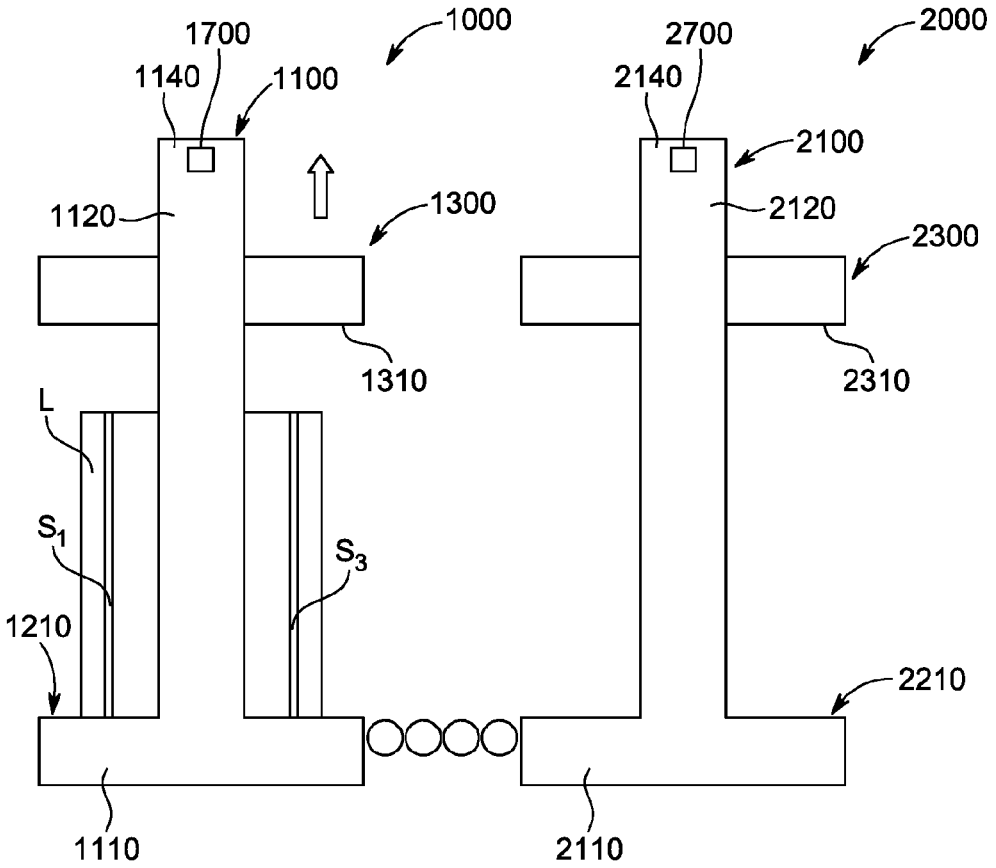
Figure 4E:
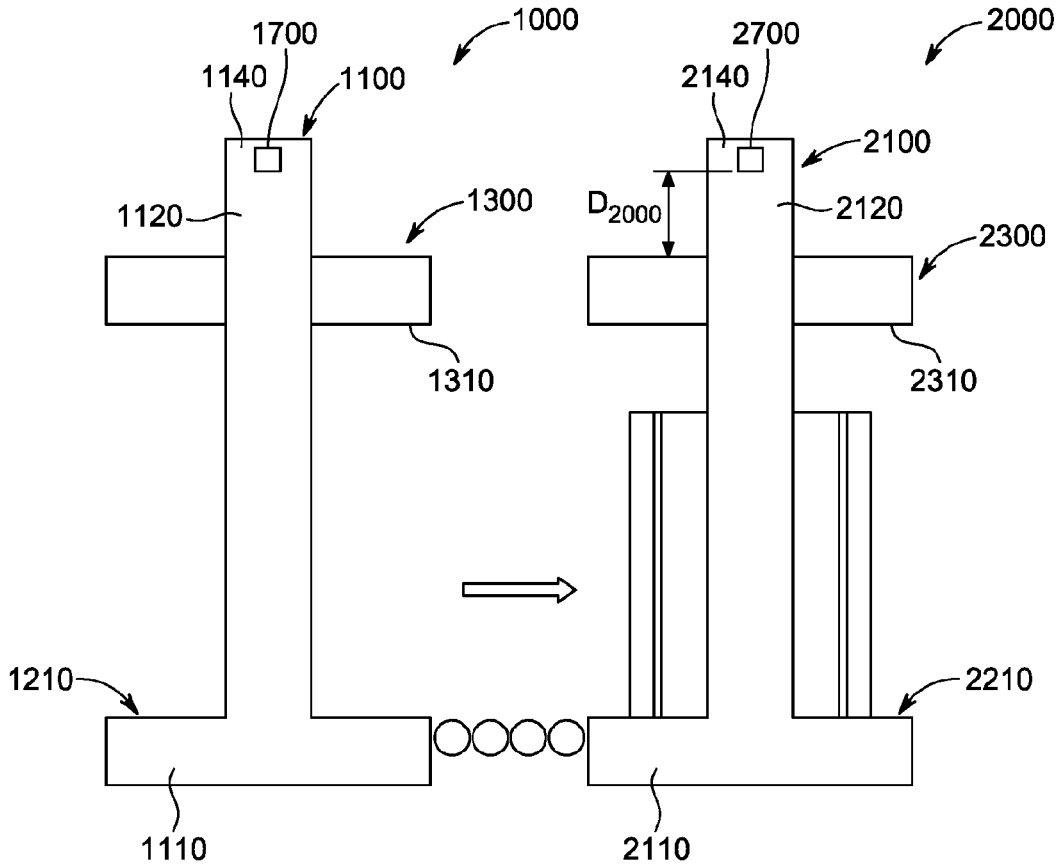

The controller 1800 controls the strapping heads 1500 to strap the load L, as block 910 indicates. In this example embodiment, the first strapping machine 1000 includes three strapping heads 1500 that apply first ($S_1$), second (not shown), and third ($S_3$) straps to the load L, as shown in FIG. 4C. The controller 1800 then controls the platen actuator 1350 to move the platen 1300 away from the support surface 1210 so the platen disengages the load L, as block 912 indicates and as shown in FIG. 4D.

The controller 1800, the controller 2800, or a separate controller of the system (depending on the embodiment) determines a second strapping position for the platen 2300 of the second strapping machine 2000, as block 914 indicates. The distance between the platen 2300 (and specifically the compression surfaces 2310) and the support surface 2210 when the platen 2300 is in the second strapping position is the strapping distance $D_S$ (or substantially the same as the strapping distance $D_S$), as block 914 also indicates. In this example embodiment, distance between the compression surface 2310 and the support surface 2210 when the platen 2300 is in the second strapping position is within 5% and preferably within 1% of the distance between the compression surface 1310 and the support surface 1210 when the platen 1300 is in the first strapping position. Since respective platens of the strapping machines are the same (or substantially the same) distance from their respective support surfaces when in their respective strapping positions, the load L will be the same (or substantially the same) height during both strapping operations.

The load L is then moved (with the help of the conveyor) from the strapping area of the first strapping machine 1000 to a strapping area atop the support surface 2210 and beneath the platen 2300 of the second strapping machine 2000, as block 916 indicates and as shown in FIG. 4 E. The controller 2800 controls the platen actuator 2350 to move the platen 2300 toward the support surface 2210, into contact with the load L, and to the second strapping position, as block 918 indicates and as shown in FIG. 4F. In this example embodiment, the controller 2800 uses distance readings received from the distance sensor 2700, which the controller 2800 uses to determine the distance $D_{2000}$, to determine when the platen 2300 reaches the second strapping position. As shown in FIG. 4F, the distance between the platen 2300 (and specifically the compression surfaces 2310) and the support surface 2210 is the strapping distance Ds when the platen 2300 is in the second strapping position.

Figure 4F:
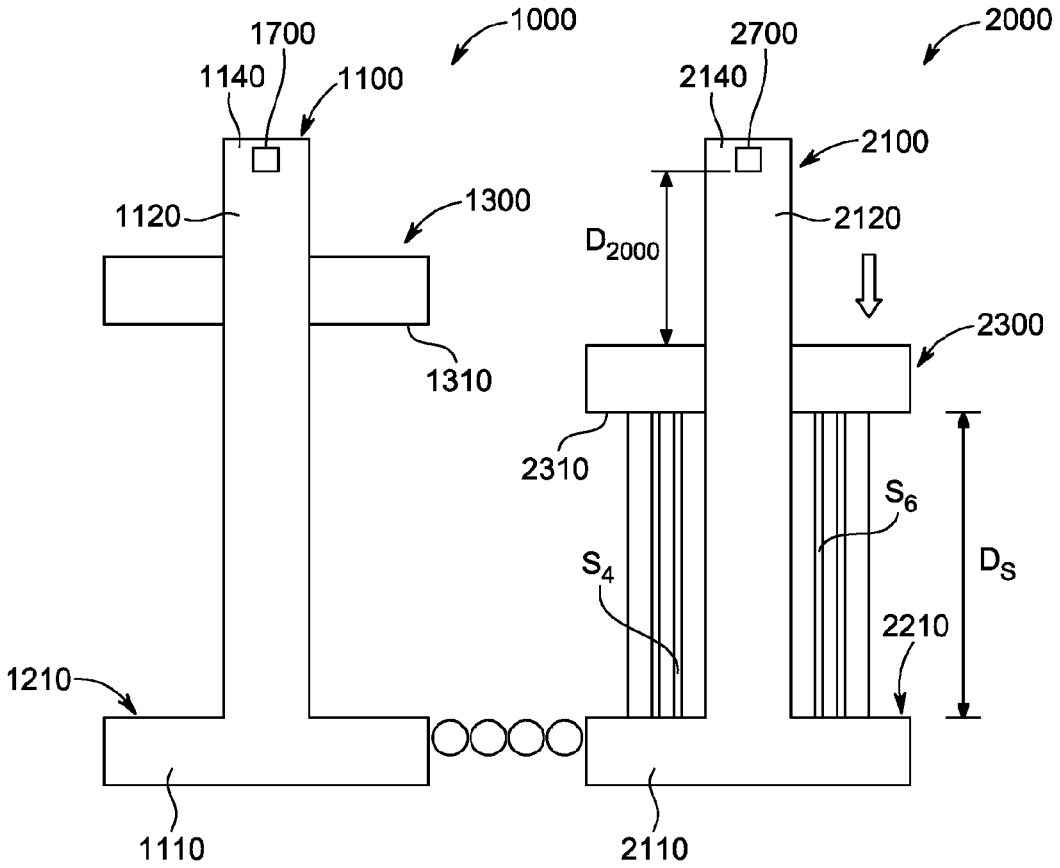

The controller 2800 controls the strapping heads 2500 to strap the load L, as block 920 indicates. The second strapping machine 2000 includes three strapping heads 2500 that apply fourth ($S_4$), fifth (not shown), and sixth ($S_6$) straps to the load L, as shown in FIG. 4F. The controller 2800 then controls the platen actuator 2350 to move the platen 2300 away from the support surface 2210 so the platen disengages the load L, as block 922 indicates. The load L is then moved out of the strapping area of the second strapping machine 2000, as block 924 indicates.

The system of the present disclosure solves the above-described loose strap problems of prior art systems. Specifically, the first strapping machine ensures the load is adequately compressed and either directly or indirectly determines the height of the load when strapped. The second strapping machine compresses the load until the height of the load is same (or substantially the same) as it was when strapped by the first strapping machine and then straps the load. Since the load is compressed to the same height before each strapping operation-instead of being compressed until to the same (or substantially the same) target compression force is reached subsequent strapping operations will not loosen the straps applied during earlier strapping operations. This results in more secure strapped loads because the force the load applies on the straps (which prevent the load from expanding) is shared equally (or substantially equally) among all the straps rather than the subset of tighter straps.

In various embodiments, such as those in which the first and second strapping machines of the system are the same, the controller of the first strapping machine does not determine the distance between the platen and the support surface when the platen is in the first strapping position. Rather, the controller of the first strapping machine determines the distance between the distance sensor and the platen (or target) and sends that distance to the controller of the second strapping machine. Since the first and second strapping machines are identical, the second strapping position for the platen of the second strapping machine is the same as the first strapping position for the platen of the first strapping machine. In other words, since the machines are identical, the controller of the second strapping machine ensures the distance between the distance sensor and the platen (or target) of the second strapping machine when the platen is in the second strapping position is substantially the same as the distance between the distance sensor and the platen (or target) of the first strapping machine when the platen is in the first strapping position, which ensures the load is substantially the same height during both strapping processes.

In certain embodiments, the controller of the second strapping machine begins moving the platen of the second strapping machine (via the platen actuator) toward the second strapping position before the load reaches the strapping area of the second strapping machine. In other words, as the load is moving from the strapping area of the first strapping machine to the second strapping machine, the platen of the second strapping machine is already descending toward the second strapping position. This can (at least in certain situations) result in the platen being almost at the second strapping position by the time the load reaches the strapping area. So long as the platen of the second strapping machine begins moving toward the second strapping position before the load reaches the strapping area of the second strapping machine, this functionality increases throughput since the system does not have to wait for the load to get into position before moving the platen.

The invention claimed is:

1. A system comprising:

a first strapping machine comprising a first frame, a first platen supported by the first frame, a first load supporter below the first platen, a first platen actuator operably connected to the first platen to move the first platen toward and away from the first load supporter, and a first strapping head;

a second strapping machine downstream of the first strapping machine, the second strapping machine comprising a second frame, a second platen supported by the second frame, a second load supporter below the second platen, a second platen actuator operably connected to the second platen to move the second platen toward and away from the second load supporter, and a second strapping head; and one or more controllers configured to:

control the first platen actuator to move the first platen toward the first load supporter and a load positioned in a first strapping area on the first load supporter and beneath the first platen;

monitor a compressive force the first platen applies to the load;

responsive to the compressive force reaching a target compressive force:

stop moving the first platen, wherein when stopped the first platen is in a first strapping position at which a strapping distance separates the first platen and a first support surface of the first load supporter;

control the first strapping head to strap the load; and control the first platen actuator to move the first platen away from the first load supporter and disengage the load;

move the load to a second strapping area on the second load supporter and beneath the second platen;

control the second platen actuator to move the second platen to a second strapping position in which the second platen and a second support surface of the second load supporter are separated by a distance substantially the same as the strapping distance; and control the second strapping head to strap the load.

2. The system of claim 1, wherein the first strapping machine further comprises a compression sensor configured to detect a force applied to the first load supporter and to transmit a force reading representative of the detected force to the one or more controllers, wherein the one or more controllers are further configured to determine the compressive force the first platen applies to the load based on one or more force readings received from the compression sensor.

3. The system of claim 1, wherein the first strapping machine further comprises a distance sensor configured to detect the distance between the first platen and a designated component of the first strapping machine and to transmit a distance reading representative of the detected distance to the one or more controllers, wherein the one or more controllers are configured to determine the second strapping position based on the detected distance.

4. The system of claim 3, wherein the one or more controllers comprise a first strapping-machine controller of the first strapping machine and a second strapping-machine controller of the second strapping machine, wherein the distance sensor configured to transmit the distance reading to the first strapping-machine controller, wherein the first strapping-machine controller is configured to transmit the distance reading to the second strapping-machine controller, wherein the second strapping-machine controller is configured to determine the second strapping position based on the distance reading.

5. The system of claim 3, wherein the designated component comprises the distance sensor.

6. The system of claim 5, wherein the distance sensor comprises a laser sensor, wherein the first platen further comprises a target configured to reflect a beam emitted from the laser sensor.

7. The system of claim 1, wherein the distance separating the second platen and the second support surface of the second load supporter when the second platen is at the second strapping position is the same as the strapping distance.

8. The system of claim 1, wherein the one or more controllers are further configured to control the second platen actuator to begin moving the second platen towards the second strapping position before the load reaches the second strapping area.

9. The system of claim 1, wherein the first strapping machine further comprises a compression sensor and a distance sensor, wherein the compression sensor is configured to detect a force applied to the first load supporter and to transmit a force reading representative of the detected force to the one or more controllers, wherein the one or more controllers are further configured to determine the compressive force the first platen applies to the load based on one or more force readings received from the compression sensor, wherein the distance sensor is configured to detect the distance between the first platen and a designated component of the first strapping machine and to transmit a distance reading representative of the detected distance to the one or more controllers, wherein the one or more controllers are configured to determine the second strapping position based on the detected distance.

10. The system of claim 9, wherein the second strapping machine further comprises a second distance sensor configured to detect the distance between the second platen and a second designated component of the second strapping machine and to transmit a distance reading representative of the detected distance to the one or more controllers, wherein the one or more controllers are configured to move the second platen to the second strapping position based on one or more distance readings received from the second distance sensor.

11. The system of claim 9, wherein the designated component comprises the distance sensor.

12. A method of strapping a load, the method comprising:

moving a first platen of a first strapping machine toward a first load supporter of the first strapping machine and a load positioned in a first strapping area on the first load supporter and beneath the first platen;

monitoring a compressive force the first platen applies to the load;

responsive to the compressive force reaching a target compressive force:

stopping the first platen, wherein when stopped the first platen is in a first strapping position at which a strapping distance separates the first platen and a first support surface of the first load supporter;

strapping the load with a first strapping head of the first strapping machine; and moving the first platen away from the first load supporter and so it disengages the load;

moving the load to a second strapping area on a second load supporter of a second strapping machine and beneath a second platen of the second strapping machine;

moving the second platen to a second strapping position in which the second platen and a second support surface of the second load supporter are separated by a distance that is substantially the same as the strapping distance; and strapping the load with a second strapping head of the second strapping machine.

13. The method of claim 12, further comprising:

detecting, via a compression sensor, a force applied to the first load supporter; and determining the compressive force the first platen applies to the load based on the detected force.

14. The method of claim 13, further comprising:

detecting, via a distance sensor, the distance between the first platen and a designated component of the first strapping machine; and determining the second strapping position of the second platen based on the detected distance.

15. The method of claim 12, further comprising:

detecting, via a distance sensor, the distance between the first platen and a designated component of the first strapping machine; and determining the second strapping position based on the detected distance.

16. The method of claim 15, further comprising:

transmitting, by a first strapping-machine controller of the first strapping machine, the detected distance to a second strapping-machine controller of the second strapping machine; and determining, by the second strapping-machine controller, the second strapping position based on the detected distance.

17. The method of claim 12, wherein the distance separating the second platen and the second support surface of the second load supporter when the second platen is at the second strapping position is the same as the strapping distance.

18. The method of claim 12, further comprising starting to move the second platen towards the second strapping position before the load reaches the second strapping area.

19. The method of claim 12, further comprising:

detecting, via a compression sensor, a force applied to the first load supporter;

determining the compressive force the first platen applies to the load based on the detected force;

detecting, via a distance sensor, the distance between the first platen and a designated component of the first strapping machine; and determining the second strapping position based on the detected distance.

20. The method of claim 19, further comprising:

detecting, via a second distance sensor, the distance between the second platen and a second designated component of the second strapping machine; and moving the second platen to the second strapping position based on one or more distance readings received from the second distance sensor.

* * * * *